United States Patent [19]

Bouchard

[11] Patent Number: 5,039,908

[45] Date of Patent: Aug. 13, 1991

[54] TRI-MODEL THERMAL SWITCH AND PREHEAT LAMP CONTAINING SAME

[75] Inventor: Andre C. Bouchard, Peabody, Mass.

[73] Assignee: GTE Products Corporation, Danvers, Mass.

[21] Appl. No.: 397,539

[22] Filed: Aug. 23, 1989

[51] Int. Cl.[5] ..... H01J 17/12; H01J 61/64

[52] U.S. Cl. ..... 313/619; 313/631; 315/73

[58] Field of Search ..... 313/491, 601, 619, 631; 315/73, 74, 75

[56] References Cited

U.S. PATENT DOCUMENTS

| | | | |
|---|---|---|---|
| 2,337,993 | 12/1943 | Hall, Jr. et al. | 315/278 |
| 2,341,990 | 4/1944 | Inhan et al. | 313/619 |
| 2,432,488 | 12/1947 | Peacock et al. | 315/73 |

*Primary Examiner*—Donald J. Yusko
*Assistant Examiner*—Diab Hamadi
*Attorney, Agent, or Firm*—Carlo S. Bessone

[57] ABSTRACT

A tri-model thermal switch for use in a preheat-type discharge lamp. The thermal switch includes a glass bulb, first and second electrical leads sealed into and passing through the glass bulb, and a bimetallic element disposed within the bulb and having first and second end portions. The first end portion of the bimetallic element is affixed to the first electrical lead while the second end portion of the bimetallic element is formed to be in contact with the second electrical lead at a first elevated temperature higher than ambient temperature. The bimetallic element is spaced from the second electrical lead at ambient temperature and at a second elevated temperature higher than the first elevated temperature. During lamp operation, the thermal switch produces a double hot spot on the cathode by electrically shorting the cathode lead-in wires. As a result, the electrode temperature is lowered sufficiently to cause an improvement in the lumen maintenance and life of the lamp.

6 Claims, 3 Drawing Sheets

(ROOM TEMP.)

(100°C)

(300°C)

TRI-MODEL THERMAL SWITCH AND PREHEAT LAMP CONTAINING SAME

CROSS-REFERENCE TO A RELATED APPLICATION

This application discloses, but does not claim, inventions which are claimed in U.S. Ser. No. 07/397,230, now U.S. Pat. No. 5,001,394, filed concurrently herewith and assigned to the Assignee of this application.

FIELD OF THE INVENTION

This invention relates in general to a fluorescent lamp and pertains, more particularly, to a preheat-type negative glow discharge lamp containing a thermal switch.

BACKGROUND OF THE INVENTION

A negative glow discharge lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. At least one of the electrodes is in the form of an electron emissive cathode. In a d.c. operated preheat-type lamp having an anode and cathode, the cathode is preheated to electron emitting temperature for several seconds. Current flows between the electrodes after a certain potential is applied to the electrodes, commonly referred to as the breakdown voltage. An elementary explanation of the phenomenon is that the gas between the electrodes becomes ionized at a certain voltage, conducts current and emit ultraviolet radiation. The ultraviolet radiation is converted to visible radiation by means of a phosphor layer disposed on the inner surface of the lamp envelope. It is understood that what is meant by a negative glow discharge lamp, as distinguished from a positive column lamp, is one in which the anode is positioned so that no appreciable positive column is developed within the discharge.

During operation of a fluorescent lamp, it is advantageous to produce a double hot spot on the cathode so as to lower the electrode temperature. The reduced electrode temperature has been found to cause an improvement in the lumen maintenance and life of the lamp. U.S. Pat. No. 2,337,993, which issued to Hall, Jr., et al on Dec. 28, 1943, discloses a lamp comprising a plurality of cathodes arranged and combined in a manner to provide a plurality of emissive or hot spots on each cathode of each electrode. This patent requires special circuitry to operate a lamp wherein each end electrode has a plurality of cathodes.

An article entitled "High Frequency Operation Producing Double Hot Spots on Electrodes for Fluorescent Lamps" in Journal of the Illuminating Engineering Society (Summer 1987) by Yuhara et al lists various methods for producing a double hot spot. The article details, in particular, circuits wherein the frequencies of the lamp current and the filament voltage are different.

Thermal switches have been used in rapid-start and preheat-type fluorescent lamp for various purposes. For example, U.S. Pat. No. 4,616,156, which issued to Roche et al on Oct. 7, 1986 discloses a rapid-start lamp containing a thermal switch. The thermal switch is connected in series with the cathode for discontinuing heater current upon operation of the fluorescent lamp to reduce energy requirements. U.S. Pat. No. 2,351,305, which issued to Thayer on June 13, 1944, discloses a preheat-type fluorescent lamp having a thermal switch located within the lamp base structure. The thermal switch is connected in series with the cathode filament to provide preheating current to the filament prior to lamp ignition.

SUMMARY OF THE INVENTION

It is, therefore, an object of the present invention to obviate the disadvantages of the prior art.

It is another object of the invention to provide an enhanced thermal switch and an improved preheat-type fluorescent lamp.

It is still another object of the invention to provide a fluorescent lamp having improved lumen maintenance and life.

It is a further object of the invention to provide an alternative technique for producing a plurality of hot spots on the cathode.

It is still another object of the invention to provide a technique for producing a plurality of hot spots on the cathode which is relatively easy to implement.

It is another object of the invention to a method for producing a plurality of hot spots on the cathode which does not require special circuitry or a lamp having a plurality of cathodes.

These objects are accomplished in one aspect of the invention by the provision of a tri-model thermal switch which includes a glass bulb, first and second electrical leads sealed into and passing through the glass bulb, and a bimetallic element disposed within the bulb and having first and second end portions. The first end portion of the bimetallic element is affixed to the first electrical lead. The second end portion of the bimetallic element is formed to be in electrical contact with the second electrical lead at a first elevated temperature, higher than ambient temperature and electrically spaced from the second electrical lead at ambient temperature and at a second elevated temperature higher than the first elevated temperature.

In accordance with further teachings of the present invention, the first elevated temperature higher than ambient temperature is about 100 degrees Celsius. Preferably, the second elevated temperature higher than the first elevated temperature is about 300 degrees Celsius and ambient temperature is 25 degrees Celsius.

The objects are accomplished in another aspect of the invention by the provision of a preheat-type discharge lamp, such as a glow discharge lamp, including a light-transmitting envelope containing an ionizable medium. A phosphor coating is disposed on the inner surface of the envelope. A pair of electrodes is disposed within the envelope. First and second lead-in wires support one of the electrodes. A thermal switch is located within the envelope shunting at least one of the electrodes and electrically coupled to the first and second lead-in wires. The thermal switch includes a glass bulb, first and second electrical leads sealed into and passing through the glass bulb, and a bimetallic element disposed within the bulb and having first and second end portions. The first end portion of the bimetallic element is affixed to the first electrical lead. The second end portion of the bimetallic element is formed to be in electrical contact with the second electrical lead at a first elevated temperature, higher than ambient temperature and electrically spaced from the second electrical lead at ambient temperature and at a second elevated temperature higher than the first elevated temperature. A double hot spot is produced on the shunted electrode during lamp operation as a result of the closure of the thermal switch.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
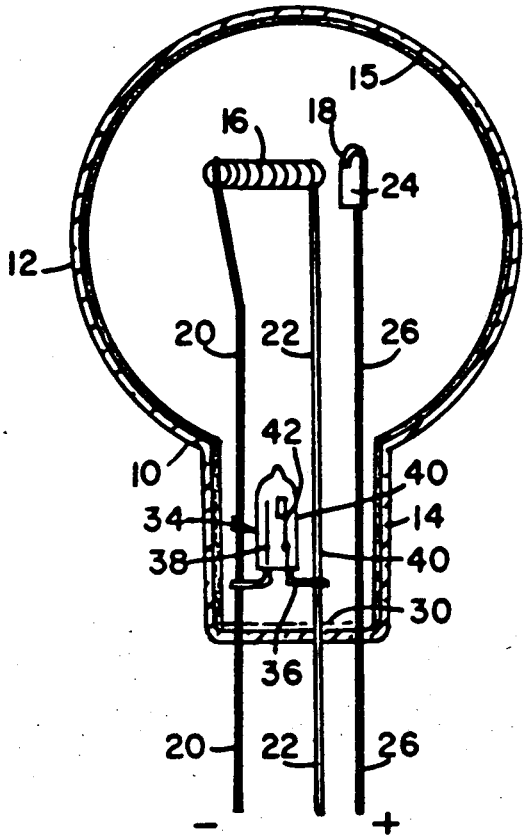
FIG. 1 represents an elevated cross-sectional view of a negative glow discharge lamp containing a tri-model thermal switch according to the present invention.

Referring to the drawings, FIG. 1 illustrates a fluorescent lamp such as a negative glow discharge lamp including a light-transmitting envelope 10 that has a bulbous region 12 and a neck region 14. Within bulbous region 12 of envelope 10 there is disposed a pair of electrodes such as a cathode electrode 16 and an anode electrode 18. The cathode electrode may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time. Lead-in wires 20 and 22 support cathode electrode 16 and provide electrical power thereto. Anode electrode 18 comprises a strip 24 of molybdenum foil supported by a single lead-in wire 26. Lead-in wires 20, 22, 26 are hermetically sealed such as by means of a wafer stem assembly 30 that closes the bottom neck region 14 of the lamp envelope as illustrated in FIG. 1. The lead-in wires may be rod-like of say 20–30 mil diameter.

The envelope contains an ionizable medium that emits ultraviolet radiation upon excitation. This ionizable medium may contain mercury and a noble gas or a mixture of noble gases. In one embodiment, the lamp may be filled with a noble gas mixture at 3 torr. This mixture may be 99.5% neon and 0.5% argon at 1.5 torr with approximately 30 milligrams of mercury. The inner surface of lamp envelope 10 has a phosphor coating 15 which emits visible light upon absorption of ultraviolet radiation.

In accordance with the teachings of the instant invention, the glow discharge lamp further includes a tri-model thermal switch 34 electrically coupled across cathode 16. Thermal switch 34 includes electrical leads 36, 38 sealed into and passing through a glass bulb 40. Electrical leads 36, 38 are connected to lead-in wires 22, 20, respectively. Thermal switch 34 further includes a bimetallic element 42 having one end thereof connected (e.g., by welding) to one end of lead 36. The free end of bimetallic element 42 is proximate one end of lead 38.

Figure 2A:
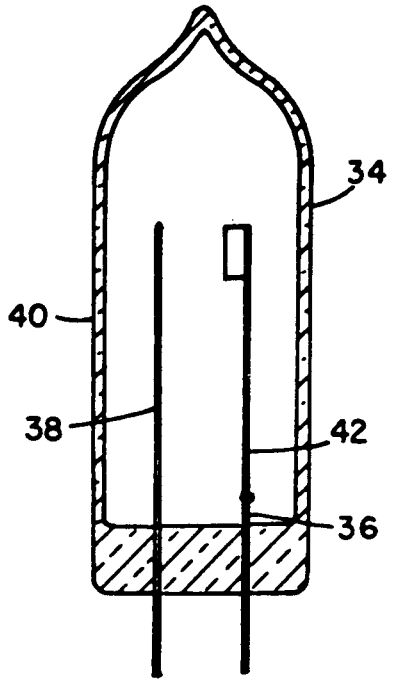
FIG. 2A is an embodiment of a tri-model thermal switch illustrating a first operational condition.
Figure 2B:
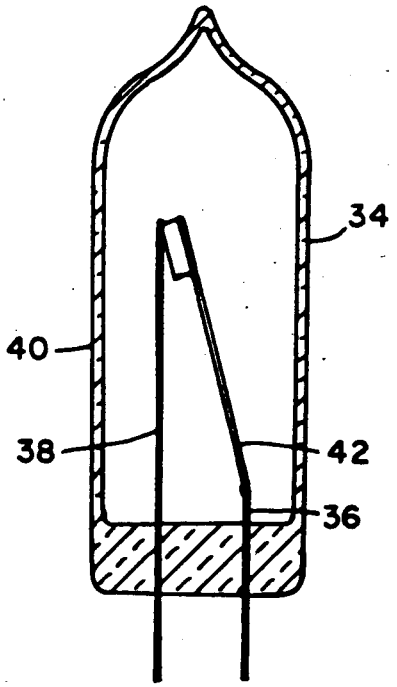
FIG. 2B illustrates a second operational condition of the tri-model thermal switch of FIG. 2A.
Figure 2C:
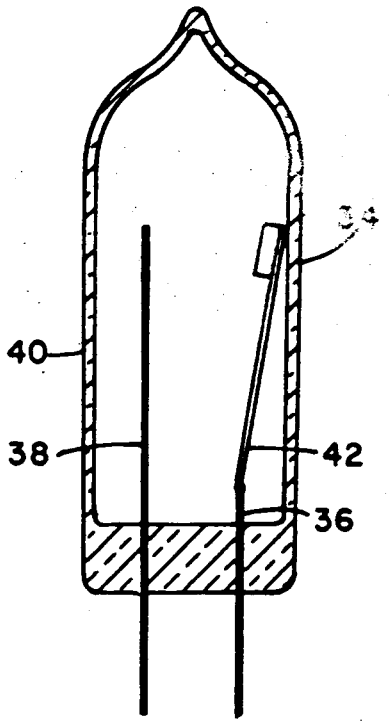
FIG. 2C illustrates a third operational condition of the tri-model thermal switch of FIG. 2A.
Figure 3:
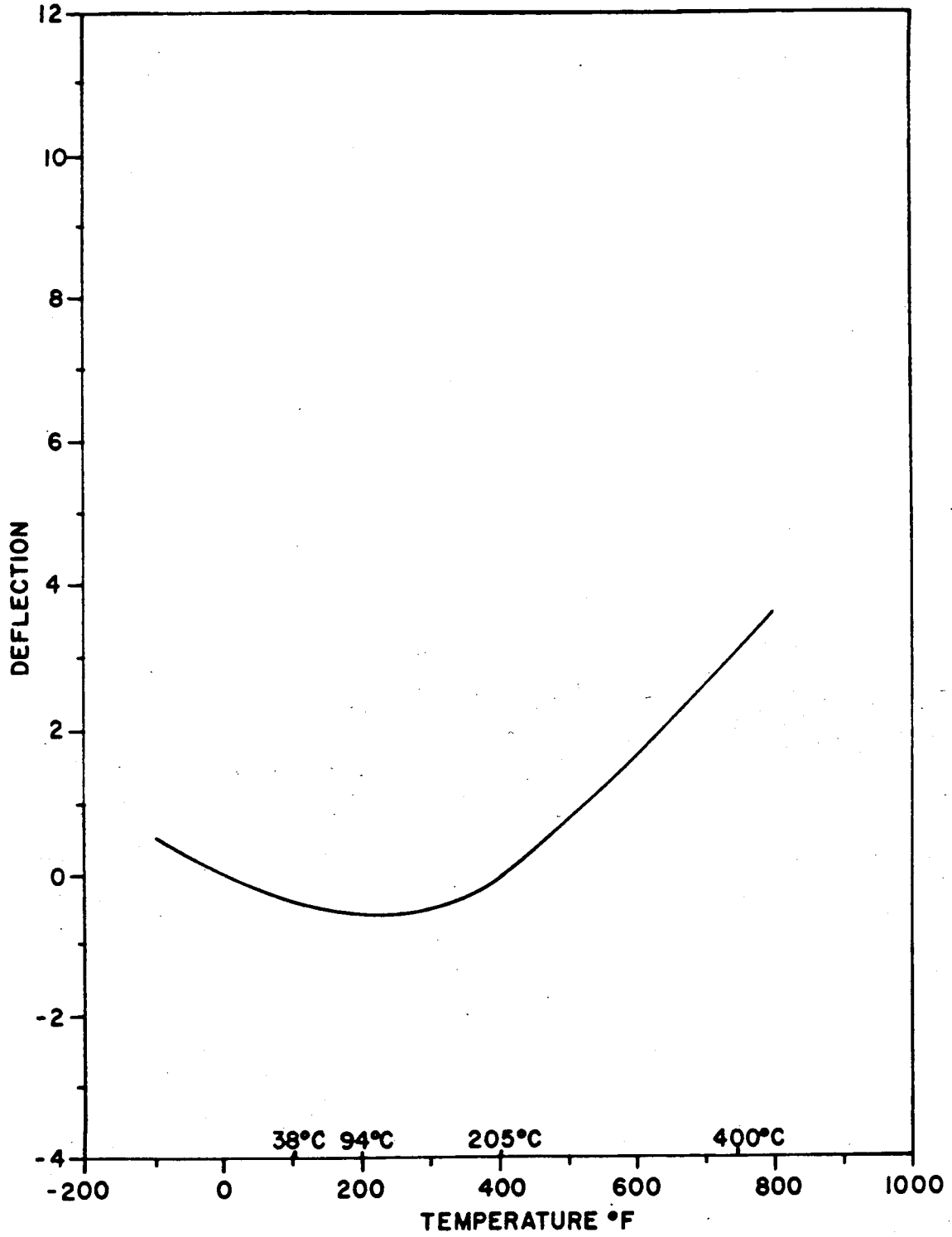
FIG. 3 is a graph depicting the deflection characteristics of a preferred material for use as the bimetallic element of the tri-model thermal switch of the present invention.

As illustrated in FIGS. 1 and 2A, thermal switch 34 is normally open at ambient room temperature such as 25 degrees Celsius. When elevated by the discharge to a temperature of about 100 degrees Celsius, bimetallic element 34 deflects towards electrical lead 38 causing closure of the thermal switch as illustrated in FIG. 2B. During the cathode activation process when the temperature reaches 300 degrees Celsius, bimetallic element 34 deflects in an opposite direction away from lead-in wire 34 and towards the glass bulb as shown in FIG. 2C so that the contacts of the thermal switch are open. One suitable material for the bimetallic element is type 4600 available from Avvanced Metallurgy Inc., Reidsville, N.C. 27320. The deflection characteristics of type 4600 is depicted in FIG. 3. As show therein, the bimetallic element deflects in one direction at temperatures up to about 100 degrees Celsius and deflects in an opposite direction at temperatures greater than 100 degrees Celsius.

In one embodiment, a 0.010 inch thick bimetal blade is used. The blade is 0.060 inch wide and 0.750 inch long. The free end of the bimetallic blade at 25 degrees Celsius can be space about 0.020 inch from the opposing lead of the thermal switch.

Closure of the thermal switch during lamp operation produces a hot spot at each end of the cathode. As a result, the electrode temperature is lowered sufficiently to cause an improvement in the lumen maintenance and life of the lamp.

To obtain the desirable switching temperatures, the thermal switch may be located in the neck region of the envelope near the base of the lamp as illustrated in FIG. 1. Moreover, in this location the thermal switch attenuates very little of the emitted light.

During lamp manufacturing, the cathode illustrated in FIG. 1 is activated by connecting an a.c. supply (not shown) to lead-in wires 20 and 22 for an amount of time sufficient to convert the carbonate material on the cathode to oxides. The lamp manufacturing temperature, which may reach 300 degrees Celsius, is sufficient to cause bimetallic element 34 to deflect away from lead 38 and towards the glass bulb. As a result, the cathode activation process is not interrupted by the thermal switch.

As to starting and operating the glow discharge lamp illustrated in FIG. 1, lead-in wire 26 is connected to the positive terminal of a d.c. power supply (not shown). Lead-in wire 20 is connected to the negative terminal of the power supply. To start the lamp, preheat current is supplied to cathode 16 by momentarily connecting together lead-in wires 22 and 26. A conventional glow discharge starter may be secured to lead-in wire 22 and 26 to facilitate the preheating and starting. Upon ignition, a glow discharge is produced between anode 18 and cathode 16. After a predetermined amount of time, such as approximately 3 to 5 seconds, the heat from the discharge causes bimetallic element 42 to contact lead 38 to electrically connect together lead-in wires 20 and 22 creating a short circuit across cathode 16. After the lamp is extinguished, the bimetallic element of the thermal switch cools within about 3 seconds and resets to a normally-open condition. The closure and reset properties of the thermal switch may be altered by composition of the switch material and placement of the switch within the lamp.

The thermal switch may have a configuration different from that illustrated in the drawings. For example, the bimetallic element may be bent in the form of a U. Moreover, the thermal switch need not include a pair of electrical leads and/or a glass bulb. For example, one end of the bimetallic element may be secured directly to one of the lead-in wires while the other end of the bimetallic element is spaced from the other lead-in wire.

As a result of the thermal switch of the present invention, a plurality of hot spots are produced on the cathode during lamp operation. The filament or cathode temperature was reduced from 1200 degrees Celsius to 1040 degrees Celsius. The lower temperature reduces barium evaporation of the lamp cathode and prolongs lamp life.

While a d.c. operated glow discharge lamp is depicted in FIG. 1, it is readily apparent to those skilled in the art that the teachings of the present invention may be applied to other types of lamps, such as fluorescent arc discharge lamps having electrodes respectively disposed at opposing ends of an elongated envelope. The lamps may be operated either a.c or d.c. For a.c. discharge lamps having a pair of electrodes in the form of tungsten exciter coils, each electrode is preferably shunted by a tri-model switch.

There has thus been shown and described a preheat-type fluorescent lamp containing a tri-model thermal switch for producing a plurality of hot spots on the cathode during lamp operation. The lamp provides improved lumen maintenance and life. The invention is relatively simply to implement and does not require the use of complex ballasting circuitry.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A preheat-type discharge lamp comprising:

a light-transmitting envelope containing an ionizable medium;

a phosphor coating disposed on the inner surface of said envelope;

a pair of electrodes disposed within said envelope;

first and second lead-in wires supporting one of said electrodes;

a thermal switch located within said envelope shunting at least said one of said electrodes and electrically coupled to said first and second lead-in wires, said thermal switch including a glass bulb, first and second electrical leads sealed into and passing through said glass bulb, and a bimetallic element disposed within said bulb and having first and second end portions, said first end portion of said bimetallic element being affixed to said first electrical lead, said second end portion of said bimetallic element being formed to be in electrical contact with said second electrical lead at a first elevated temperature higher than ambient temperature and electrically spaced from said second electrical lead at said ambient temperature and at a second elevated temperature higher than said first elevated temperature whereby a double hot spot is produced on said shunted electrode during lamp operation as a result of the closure of said thermal switch.

2. The preheat-type discharge lamp of claim 1 wherein said first elevated temperature is about 100 degrees Celsius.

3. The preheat-type discharge lamp of claim 1 wherein said second elevated temperature is about 300 degrees Celsius.

4. The preheat-type discharge lamp of claim 1 wherein said ambient temperature is a temperature of about 25 degrees Celsius.

5. The preheat-type discharge lamp of claim 1 wherein said envelope includes a bulbous region and a neck region, said thermal switch being located within said neck region of said envelope.

6. A glow discharge lamp comprising:

a light-transmitting envelope containing an ionizable medium and having a bulbous region and a neck region;

a phosphor coating disposed on the inner surface of said envelope;

a pair of electrodes disposed within said bulbous portion of said envelope;

first and second lead-in wires supporting one of said electrodes; and a thermal switch located within said neck portion of said envelope shunting at least said one of said electrodes and electrically coupled to said first and second lead-in wires, said thermal switch including a glass bulb, first and second electrical leads sealed into and passing through said glass bulb, and a bimetallic element disposed within said bulb and having first and second end portions, said first end portion of said bimetallic element being affixed to said first electrical lead, said second end portion of said bimetallic element being formed to be in electrical contact with said second electrical lead at a given range of temperatures higher than ambient temperature and electrically spaced from said second electrical lead at said ambient temperature and at temperatures higher than said given range of temperatures whereby a double hot spot is produced on said shunted electrode during lamp operation as a result of the closure of said thermal switch.

* * * * *